US006171140B1

(12) United States Patent
Anbo et al.

(10) Patent No.: US 6,171,140 B1
(45) Date of Patent: Jan. 9, 2001

(54) JOINT CONNECTOR

(75) Inventors: Tsugio Anbo; Yukifumi Machida; Yoshikatsu Hasegawa; Kenichi Suzuki, all of Tokyo (JP)

(73) Assignee: Ryosei Electro-Circuit Systems, Ltd.

( * ) Notice: Under 35 U.S.C. 154(b), the term of this patent shall be extended for 0 days.

(21) Appl. No.: 09/442,817

(22) Filed: Nov. 18, 1999

(51) Int. Cl.[7] ..... H01R 27/00
(52) U.S. Cl. ..... 439/516; 439/723
(58) Field of Search ..... 439/516, 721, 439/723, 724, 509, 511, 512, 949, 189, 212

(56) References Cited

U.S. PATENT DOCUMENTS 4,471,158 * 9/1984 Roberts ..... 174/52
5,000,699 * 3/1991 Nadin ..... 439/511
5,490,785 * 2/1996 Hein et al. ..... 439/76.1
5,540,602 * 7/1996 Bell ..... 439/721
5,964,624 * 10/1999 Pernelle ..... 439/721

* cited by examiner

*Primary Examiner*—Gary F. Paumen
*Assistant Examiner*—Ross Gushi
(74) *Attorney, Agent, or Firm*—Varndell & Varndell, PLLC

(57) ABSTRACT

A joint connector easy to construct and involving less fabricating cost. The joint connector comprises a housing 3 for accommodating a plurality of connecting terminals 2 in a rear-side portion thereof, a bus bar 6 formed out of an electrically conductive metal plate and accommodated in the housing 3 for jointing any individual ones of the connecting terminals 2, a bus bar holder 7 for holding the bus bar 6, and a front cover 9 mounted to the housing 3 in such a way as to cover the bus bar holder 7. The bus bar holder 7 has a plurality of holes to be used for cutting the bus bar 6 to form an arbitrary circuit. The bus bar holder 7 and the bus bar 6 is mounted in the housing 3 so as to be movable in relation to the housing 3 in a direction orthogonal to the direction of the connecting terminals 2 being housed. When the front cover 9 is set in the housing 3, it causes the bus bar holder 7 to be moved and the bus bar 6 to be jointed with connecting terminals 2.

9 Claims, 11 Drawing Sheets

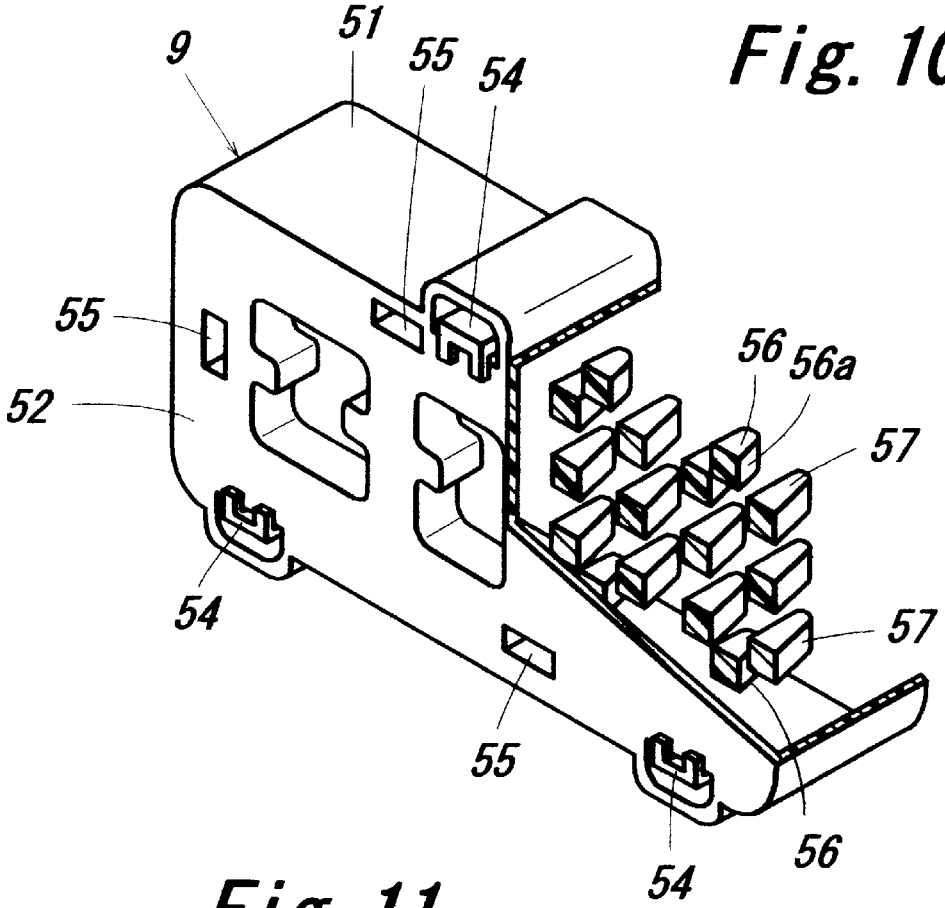
Fig. 10
Fig. 11
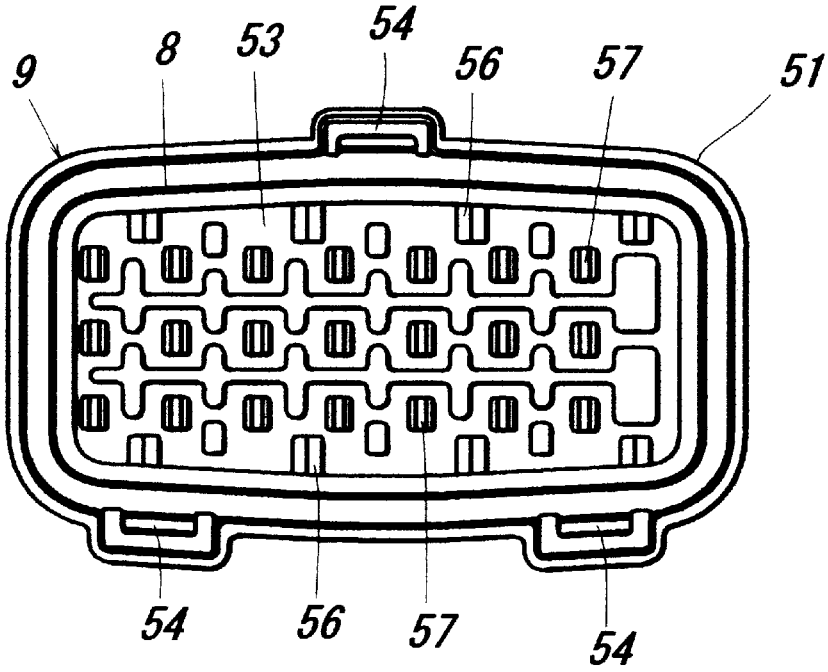

JOINT CONNECTOR

BACKGROUND OF THE INVENTION

1. Field of the Invention

The present invention relates to a joint connector having a bus bar which can be used for an automobile wire harness, for example, and can arbitrarily cause an electrical circuits of the wire harness to be branched and joined one to another.

2. Description of the Prior Art

Conventionally, a joint connector of this kind has a construction such that as FIG. 25 shows, for example, a joint box 101 and a connector 102 are coupled with each other. A housing 103 of the joint box 101 has a fitting hole 104 formed therein, and at the rear side of the fitting hole 104 there is fitted a bus bar unit 106 including a bus bar 105 having a desired circuit pattern embedded in a synthetic resin material, the bus bar 105 having tongue-like contacts. The bus bar unit 106 is locked by a locking arm 107 formed in the housing 103.

On the other hand, a housing 108 of the connector 102 has an inner cylinder portion 109, and a multiplicity of terminal housing holes 110 are provided in the inner cylinder portion 109. Housed in the terminal housing holes 110 are connecting terminals 113 which connect electrical conductor 111 to the rear side of terminal housing hole, with a wire seal member 112 fitted on electrical conductor 111. Connecting terminal 113 is prevented from slipping out rearward by a locking arm 114. On the outer periphery of the inner cylinder portion 109 at the front end thereof, with a seal member 115 fitted thereon, a front holder 116 is set in position and locked to the housing 108 by a locking arm 117 of the front holder 116.

When the front holder 116 and the seal member 115 are fitted in the fitting hole 104 of the joint box 101, the joint box 101 and the connector 102 become jointed together in waterproof condition so that desired connector terminals 113 are short-circuited by the bus bar 105 to form a circuit.

Whereas above described prior art bus bar unit 106, shown by way of example, is such that a bus bar 105 having a desired circuit pattern is embedded in a synthetic resin material, a joint connector is also known such that a cut bus bar is set in a housing molded from a synthetic resin material to form a desired circuit pattern.

In the above described prior art examples, however, since a bus bar 105 having a desired circuit pattern is embedded in a synthetic resin material, and in case that cut bus bars are set in a housing molded from a synthetic resin material to form a desired circuit pattern, so that different circuit patterns are required, it is necessary to provide a multiplicity of bus bars 105 according to the different circuit patterns and to set cut bus bars 105 in the housing. This poses the problem of increased production cost.

Therefore, the object of the present invention is to provide a joint connector which eliminates above mentioned problems, has a circuit arrangement easy to construct, and is inexpensive.

SUMMARY OF THE INVENTION

In order to accomplish the above mentioned object, the joint connector in accordance with the present invention comprises a housing for accommodating a plurality of connecting terminals in a rear-side portion thereof, a bus bar comprised of an electrically conductive metal plate accommodated in the housing for jointing any individual ones of the connecting terminals, a bus bar holder for holding the bus bar, and a front cover mounted to the housing in such a way as to cover the bus bar holder, the bus bar holder having a plurality of holes to be used in cutting the bus bar for forming an arbitrary circuit, with the bus bar holder and the bus bar mounted so as to be movable in relation to the housing in a direction orthogonal to the direction of the connecting terminals being housed, thereby to enable the bus bar to be jointed with connecting terminals.

BRIEF DESCRIPTION OF THE DRAWINGS

FIG. 10 is a partially cutaway perspective view of a front cover;

FIG. 11 is a rear elevation of a front cover equipped with a sealing member;

DETAILED DESCRIPTION OF THE PREFERRED EMBODIMENT

Figure 1:
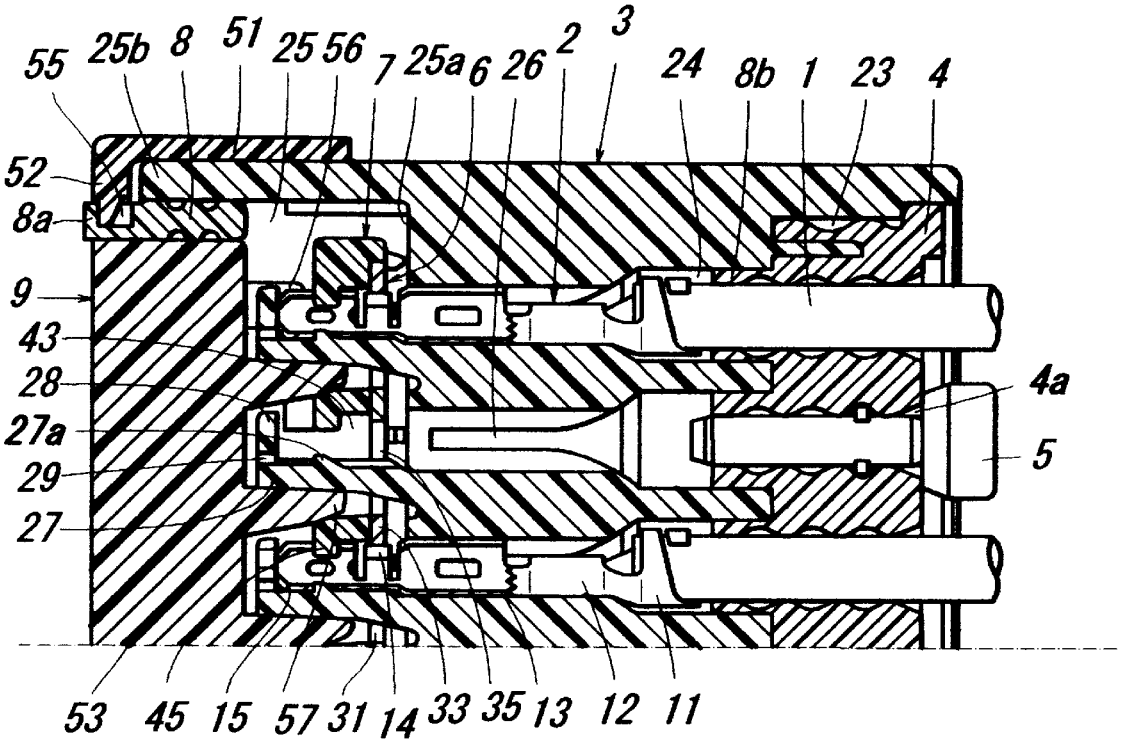
FIG. 1 is a horizontal fragmentary sectional view of one embodiment.
Figure 2:
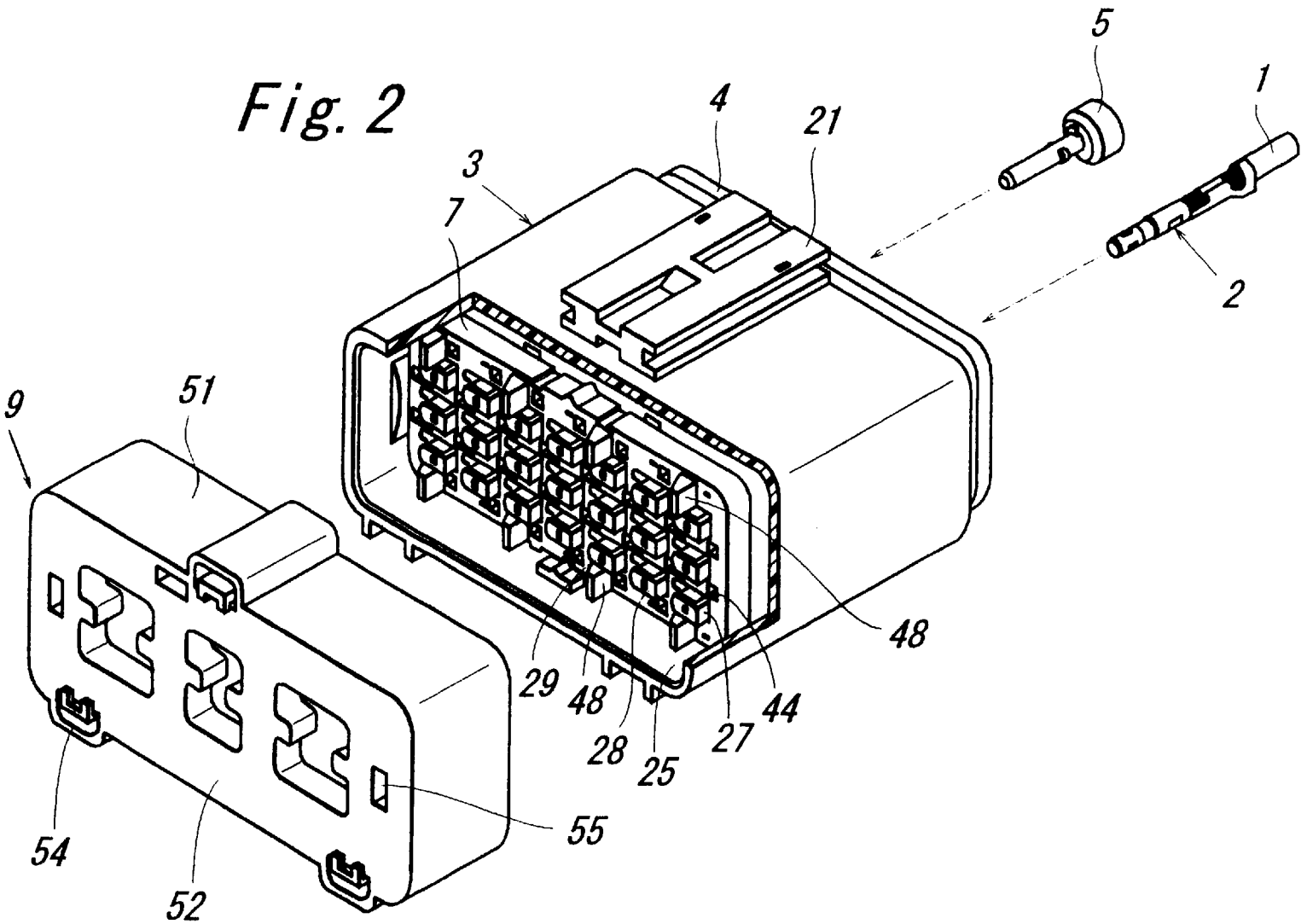
FIG. 2 is an exploded perspective view.

The invention will now be described in detail with respect to the embodiment shown in FIGS. 1 through 24. FIG. 1 is a horizontal fragmentary sectional view of the embodiment, and FIG. 2 is an exploded perspective view in which a connecting terminal 2 with an electric conductor 1 connected thereto at the rear side is housed in a housing 3 from the back side thereof. In a rear portion of the housing 3 there is provided a rear side sealing member 4 and, in case that the rear side sealing member 4 is not in use, a plug pin 5 is provided for being inserted into a terminal fitting hole 4*a* of the rear side sealing member 4 to waterproof the terminal fitting hole 4*a*. On the front side of the housing 3 there are arranged a bus bar holder 7 for holding a bus bar 6, and a front cover 9 through the intermediary of a front side sealing member 8.

Figure 3:
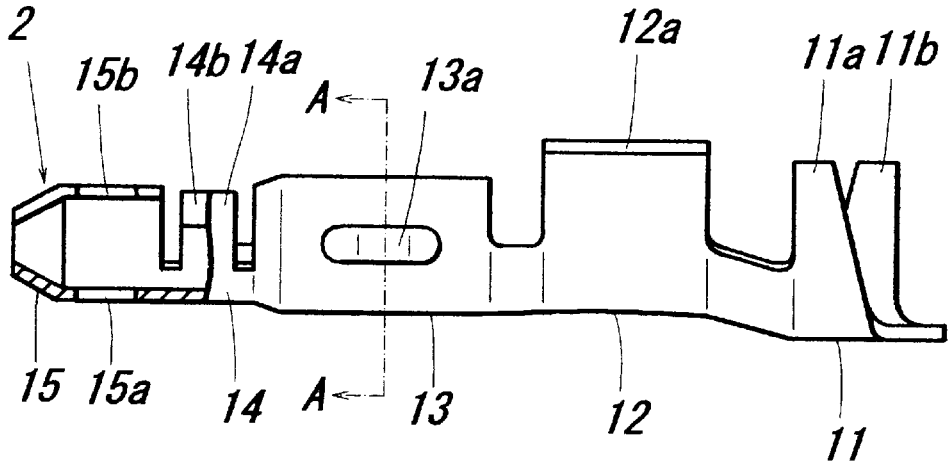
FIG. 3 is a partially cutaway side view of a connecting terminal.
Figure 4:
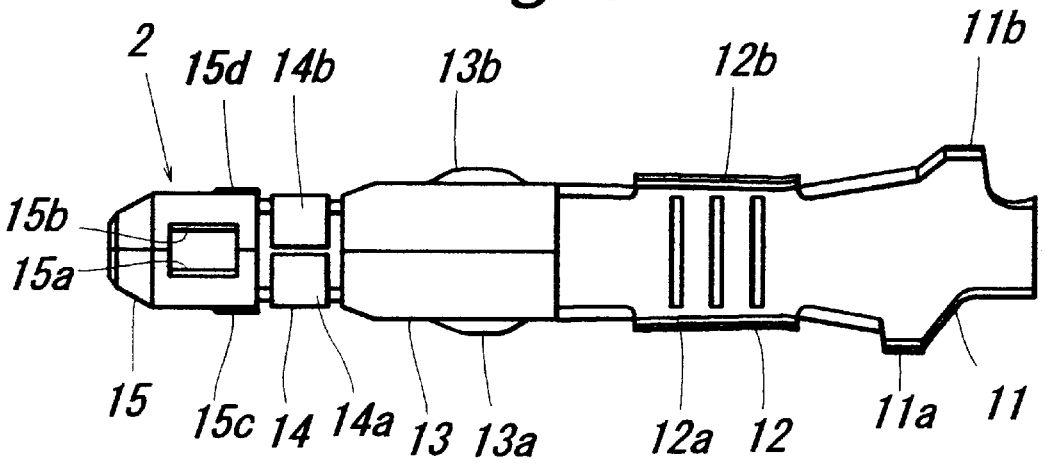
FIG. 4 is a plan view of a connecting terminal.

As shown in the side view of FIG. 3 and the plan view of FIG. 4, connecting terminal 2 includes a press covering portion 11 comprised of a pair of pressure fit pieces 11*a*, 11*b* for press fitting the covering of an electric conductor 1, a core wire press fitting portion 12 comprised of a pair of pressure fit pieces 12*a*, 12*b* for press fitting the core wire of the electric conductor 1, a stabilizer portion 13 for stabilizing the connecting terminal 2 in relation to the housing 3, a connecting portion 14 having a nearly cylinder-shaped configuration which is connected to the bus bar 6, and a cylindrical locking portion 15 locked by housing 3 and bus bar holder 7, which are arranged sequentially from back side. The locking portion 15 is formed with a lower engagement hole 15*a* for engagement by a locking projection of a locking arm of the housing 3 to be described hereinafter, and an upper engagement hole 15*b* for engagement by a locking projection of a front holder 7 to be described hereinafter. On both sides of the locking portion 15 there are formed beads 15*c*, 15*d* which regulate movement of bus bar 6 in case that connecting terminal 2 is not present at a predetermined position.

Figure 5:
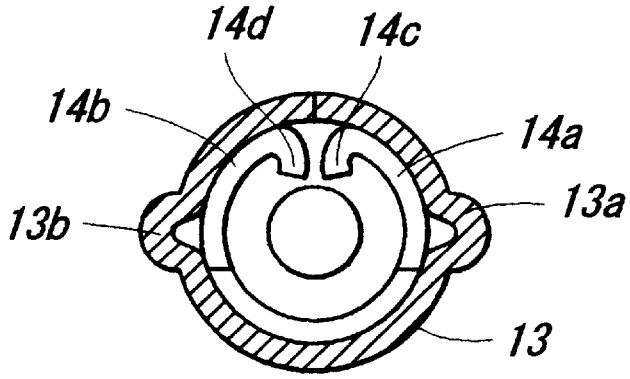
FIG. 5 is a section cut along line A—A in FIG. 3.

FIG. 5 is a section of the connecting terminal 2 shown in FIG. 4 as cut at a stabilizer portion 13 along the line A—A and viewed frontward, and at the sides of the stabilizer portion there are formed beads 13*a*, 13*b* to be guided into a guide groove of the housing 3 which will be described hereinafter. The connecting portion 14 is comprised of arcuate jointer pieces 14*a*, 14*b* having elastic resilience, and the top of jointer piece 14*a*; 14*b* is bent inward to form a bent portion 14*c*, 14*d*.

Figure 6:
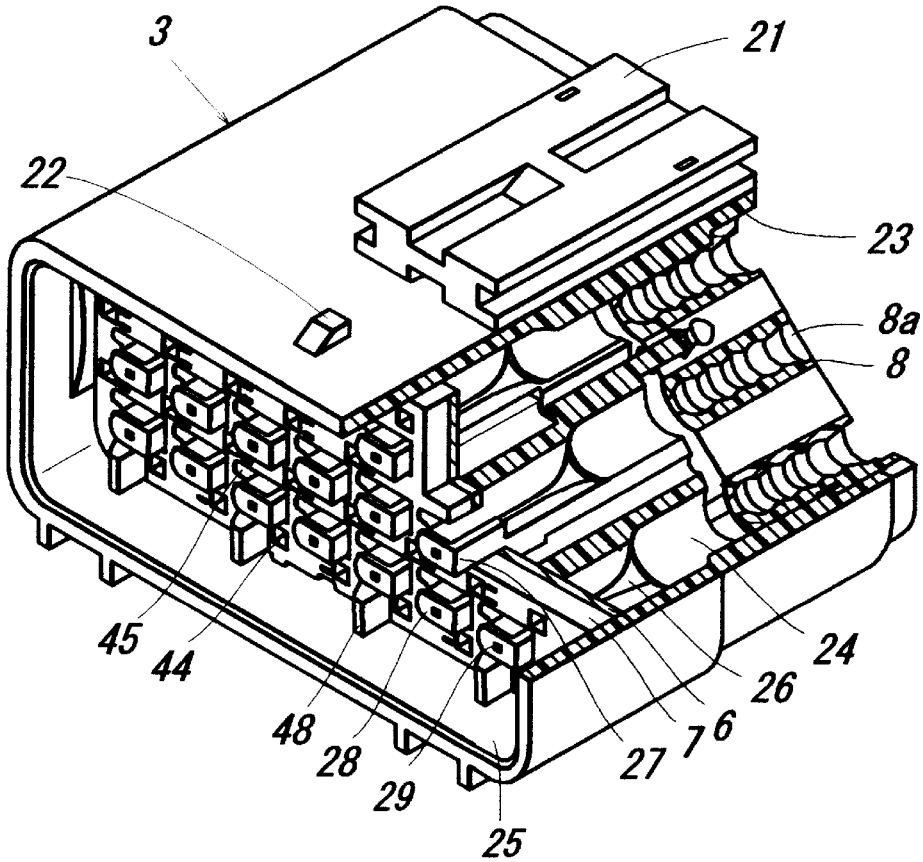
FIG. 6 is a partially cutaway sectional view of a housing equipped with a bus bar and a bus bar holder.

FIG. 6 is a partially cutaway view in perspective of the housing 3, and disposed on the top of the housing 3 are a mount 21 to be mounted to an automobile frame, for example, and a locking projection 22 engageable with a locking arm of a front cover 9 to be described hereinafter. In the housing 3 there are provided a seal housing chamber 23 for housing a rear side sealing member 4, plural terminal receiving holes 24 for housing connecting terminals 2, and a holder housing chamber 25 for housing a bus bar holder 7 holding a bus bar 6, which are formed sequentially from the back side. A portion of the front cover 9 is also housed in the holder housing chamber 25. Inside the housing 3 there is provided a locking portion for movably locking an L-shaped arm, not shown, of bus bar holder 7, which will be described hereinafter. It is noted that the number of terminal receiving holes 24 is, for example, is 3 vertical rows and 7 horizontal rows.

A pair of guide grooves 26 for guiding beads 13*a*, 3*b* of connecting terminal 2 are provided on the upper and lower walls of terminal receiving hole 24. In the holder housing chamber 25 there is provided a locking arm 27 projecting frontward from innermost wall portion for locking the connecting terminal 2 to prevent its rearward movement, while at the front end of the locking arm 27 there is provided a regulating projection 28 for regulating frontward movement of the connecting terminal 2. The regulating projection 28 has a fixture inserting hole 29 formed therein for insertion of a fixture for releasing the engagement of connecting terminal 2 and locking arm 27.

Figure 7:
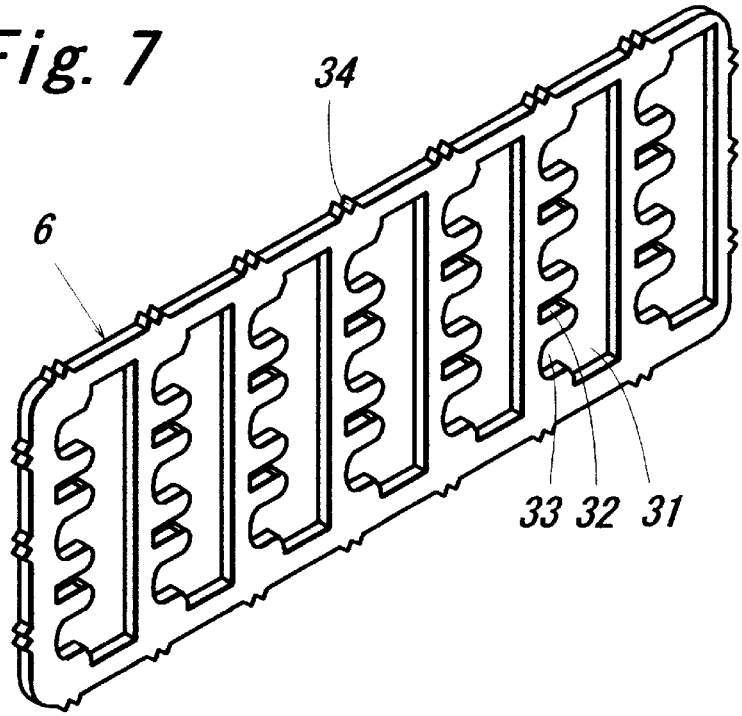
FIG. 7 is a perspective view of the bus bar.

As FIG. 7 perspective view shows, bus bar 6 is formed by punching an electrically conductive metal plate, and comprises a plurality of terminal insertion windows 31 for insertion of locking arms 27, including regulating projections 28 of the housing 3, a plurality of terminal receiving grooves 32 for receiving a joint portion 14 of the connecting terminal 2, a holder locking groove 33 to be engaged by a bus bar locking portion of front holder 7 which will be described hereinafter, and a toothed portion 34 which will go into mesh with the inner edge of a bus bar receiving groove of front holder 7 which will be described hereinafter.

Figure 8:
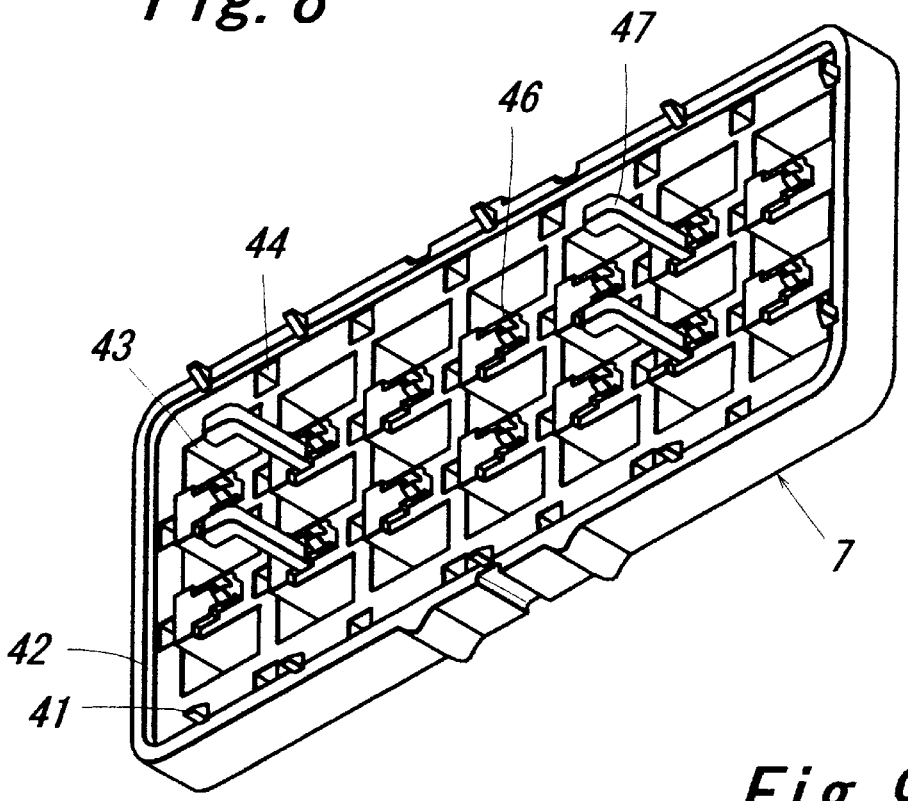
FIG. 8 is a rear view in perspective of the bus bar holder.
Figure 9:
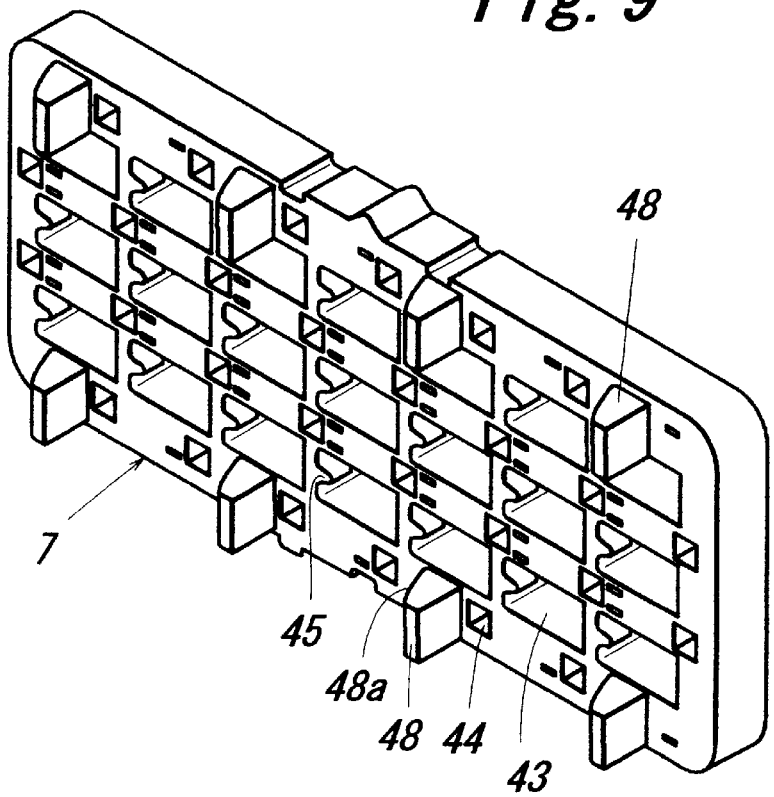
FIG. 9 is a front view in perspective of the bus bar holder.

FIG. 8 is a perspective view in rear elevation of a bus bar holder 7 and FIG. 9 is a perspective view in front elevation thereof. Along the peripheral edge of the rear side of bus holder 7 there are provided plural projections 41 arranged in abutment with the innermost wall of the housing 3, and on the inner side of the wall surrounded by the projections 41 there is provided a bus bar housing groove 42 for housing bus bars 6. At bus bar holder 7 there are provided plural through-holes 43 which allow insertion of a locking arm 27 including a regulating projection 28, and plural circuit forming holes 44 which allow insertion of a punch of an automatic punching machine for punching a predetermined circuit with respect to the bus bar 6 in a fore-and-aft extend-through relation. On the side wall of each through-hole 43 there is provided a terminal locking projection 45 engageable with an upper engagement hole 15*b* of the connecting terminal 2.

On the back side of the bus bar holder 7 there are provided a bus bar locking projection 46 which engages a holder locking groove 33 of the bus bar 6 to lock the bus bar 6, and plural L-shaped arms 47 which enter the housing 3 through an insertion window 31 of the bus bar 6 to be 25 locked by the locking portion of the housing 3. The L-shaped arm 47 is deformed by the locking portion of the housing 3 when the bus bar holder 7 is mounted to the housing 3, and after being thoroughly forced into the housing 3, the bus bar holder 7 returns to its original state and is temporarily locked at the locking portion. After return to this condition, the bus bar holder 7 is moved in a horizontal direction, whereupon it is locked in an ordinary way. At the front of bus bar holder 7, there are provided a plurality of pressed projections 48 having inclined surfaces 48*a* to be described hereinafter which are pressed by a pressing projection of the front cover 9.

FIG. 10 is a partially cutaway view in perspective of front cover 9, and FIG. 11 is a rear elevation of a front cover 9 having a front side sealing member 8. The front cover 9 has a peripheral wall 51 fitting on the front side outer periphery of the housing 3, and a front wall 52 positioned at the front of the peripheral wall 51. On the inner surface of the front wall 52 there is provided a seal fitting portion 53 on which a front side sealing member 8 is placed. On the peripheral wall 51 there is provided a locking arm 54 engageable with a locking projection 22 of the housing 3, and the front wall 52 is formed with a locking hole 55 for locking a locking portion 8*a* of the front side sealing member 8.

The front wall 52 is formed with a holder move projection 56 acting on a pressed projection 48 of bus bar older 7 and an arm pressing projection 57 acting on a locking arm 27 of the housing 3. The holder move projection 56 has an inclined surface 56*a* abutting an inclined surface 48*a* of the pressed projection 48, so that the arm pressing projection 57 can go sideways of the locking arm 27 to press the locking arm 27 against the connecting terminal 2.

For assembling a joint connector of above described construction the following process is employed.

(1) Bus bar 6 is fitted into bus bar housing groove 42 of bus bar holder 7, whereby bus bar locking projection 46 of bus bar holder 7 projects from holder locking groove 33 of bus bar 6 so that bus bar holder 7 holds bus bar 6 in a fixed condition.

Figure 12:
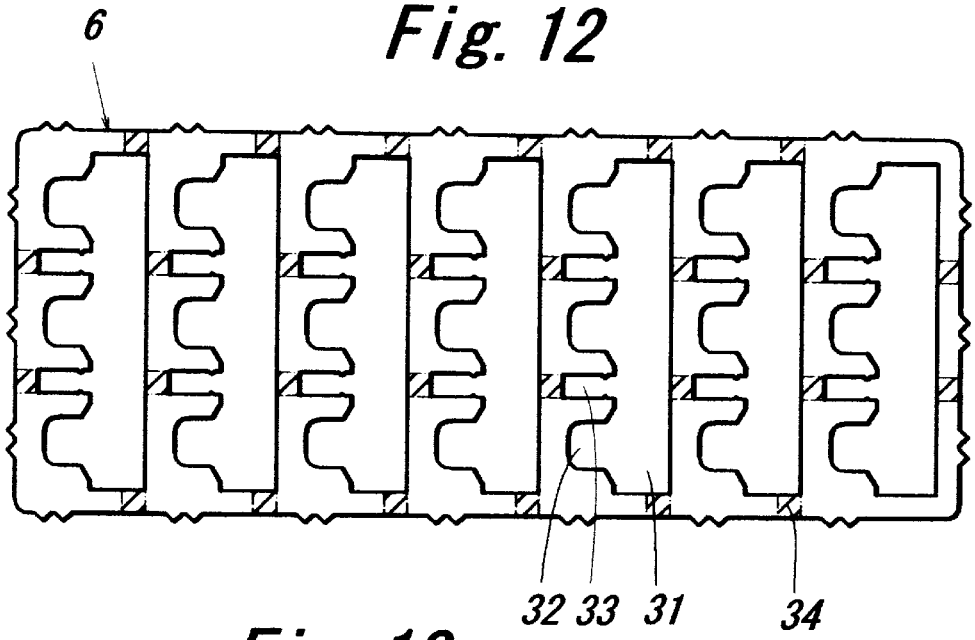
FIG. 12 is a plan view of the bus bar.

(2) Bus bar holder 7 holding a bus bar 6 is fixed to a predetermined position at a punching machine and a punch of the punching machine is caused to pass through a circuit forming hole 44 of the bus bar holder 7 and to cut intended cut portions 35 of a plurality of cut portions 35 of the bus bar 6 as shown in FIG. 12 to form a desired circuit in the bus bar 6. In this case, the bus bar 6 is fixed by the bus bar locking projection 46 for each terminal receiving groove 32 which goes into engagement with connecting terminal 2; therefore, when the bus bar 6 is cut, it will not drop from the bus bar holder 7.

(3) When so required, photo shooting is made by a circuit inspecting means not shown with respect to the front of the bus bar holder 7, and the cut portions 34 of the bus bar 6 are monitored by a monitoring portion through the circuit forming hole 44 for inspecting the condition of the circuit.

(4) The bus bar holder 7 including the bus bar 6 is set in the holder housing chamber 25 of the housing 3. At this point of time, the L-shaped arm 47 of the bus bar holder 7 is temporarily locked at the locking portion of the housing 3. Prior to this point of time, the rear side sealing member 4 is fitted in the seal receiving chamber 23 of the housing 3, and the front side sealing member 8 is mounted on the front cover 9.

Figure 13:
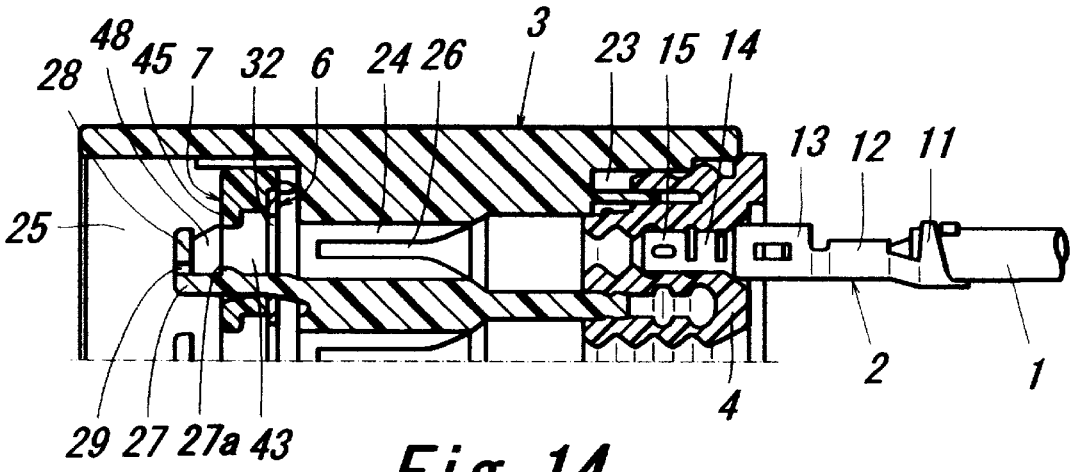
FIG. 13 is an explanatory view of function.

(5) As FIG. 13 shows, a connecting terminal 2 to which electric conductor 1 is connected is forced into terminal receiving hole 24 of the housing 3 through a terminal inserting hole 4*a* of the rear side sealing member 4.

Figure 14:
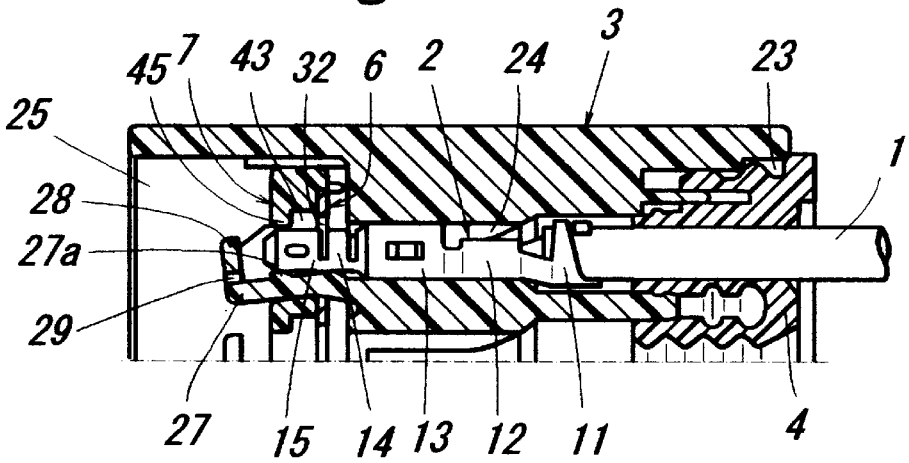
FIG. 14 is an explanatory view of function.

(6) When connecting terminal 2 is pushed further, beads 13*a*, 13*b* of stabilizer portion 13 are guided by guide groove 26 and, as shown in FIG. 14, locking portion 15 of connecting terminal 2 causes locking arm 27 to be deformed sidewise.

Figure 15:
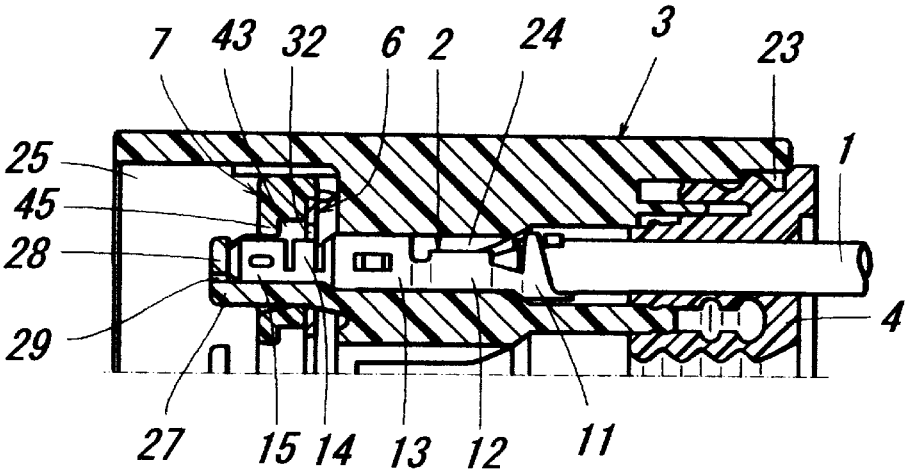
FIG. 15 is an explanatory view of function.
Figure 16:
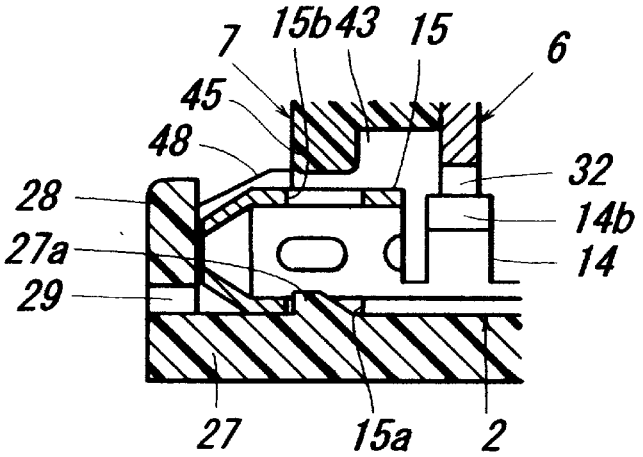
FIG. 16 is an explanatory view of function.

(7) When connecting terminal 2 is pushed further as a final pushing step, connecting terminal 2 will advance to a predetermined position as shown in FIG. 15. Then, as shown in a fragmentary enlarged view of FIG. 16, a locking projection 27*a* of locking arm 27 engages a lower engagement hole 15*a* of connecting terminal 2, and a regulating projection 28 abuts the front end of connecting terminal 2, thereby regulating forward and backward movement of connecting terminal 2.

Figure 17:
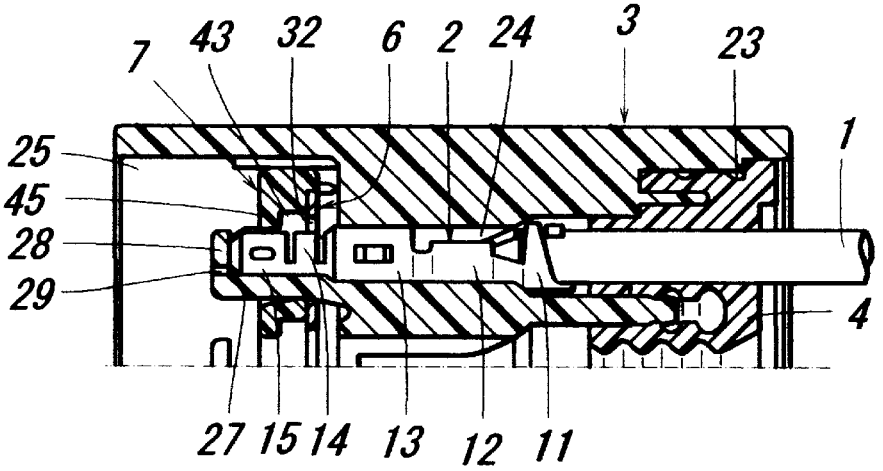
FIG. 17 is an explanatory view of function.

(8) As FIG. 17 shows, rear side sealing member 4 is thoroughly pushed inward.

Figure 18:
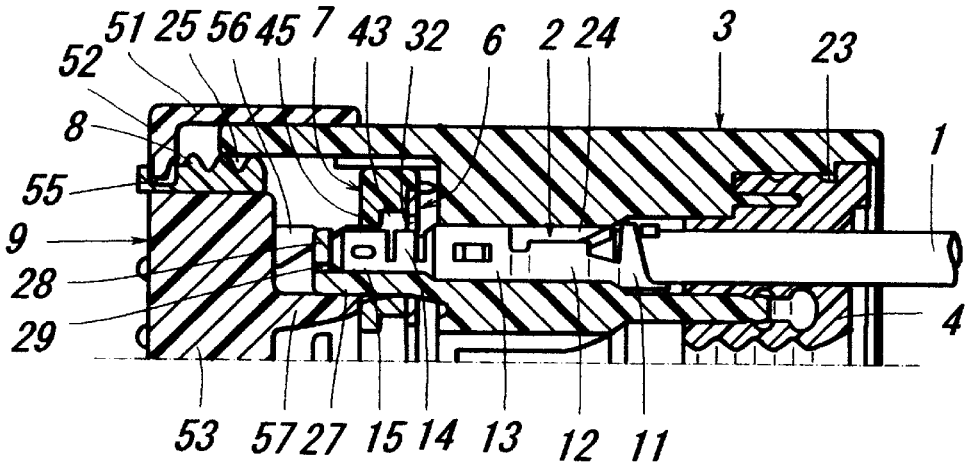
FIG. 18 is an explanatory view of function.

(9) As FIG. 18 shows, a front cover 9 having a front side sealing member fitted thereon is set in the housing 3. Thereupon, inclined surface 56*a* of holder moving projection 56 of front cover 9 will press inclined surface 48*a* of pressed projection 48 of bus bar holder 7 to cause bus bar holder 7 and bus bar 6 to move in a horizontal direction.

Figure 19:
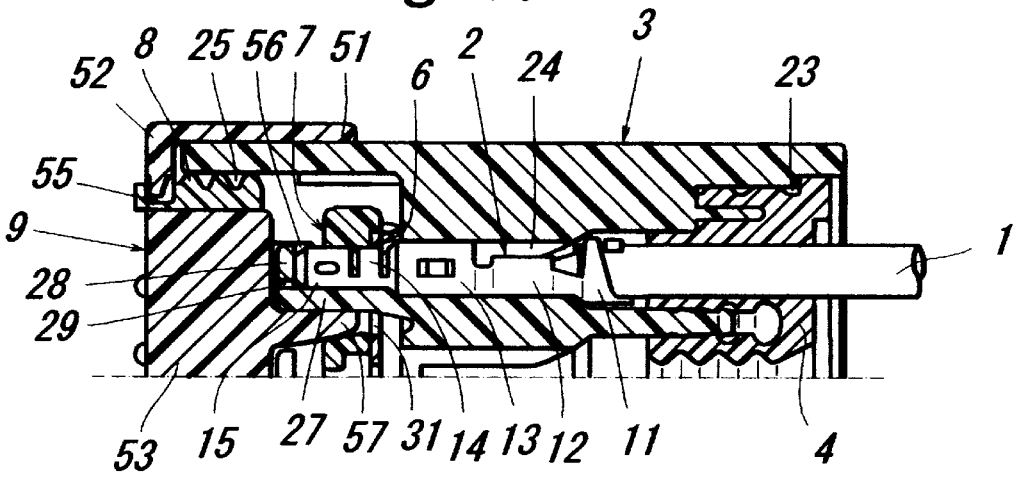
FIG. 19 is an explanatory view of function.
Figure 20:
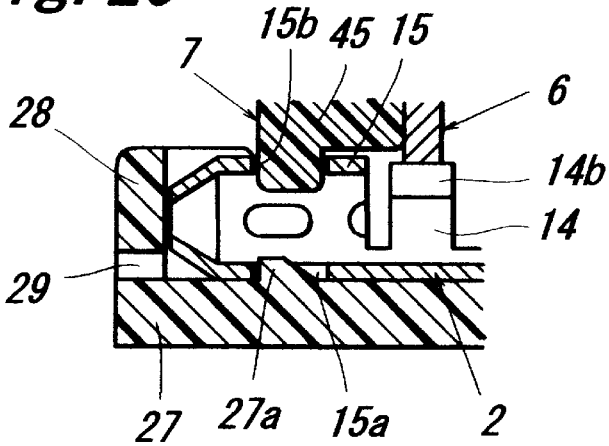
FIG. 20 is an explanatory view of function.
Figure 21:
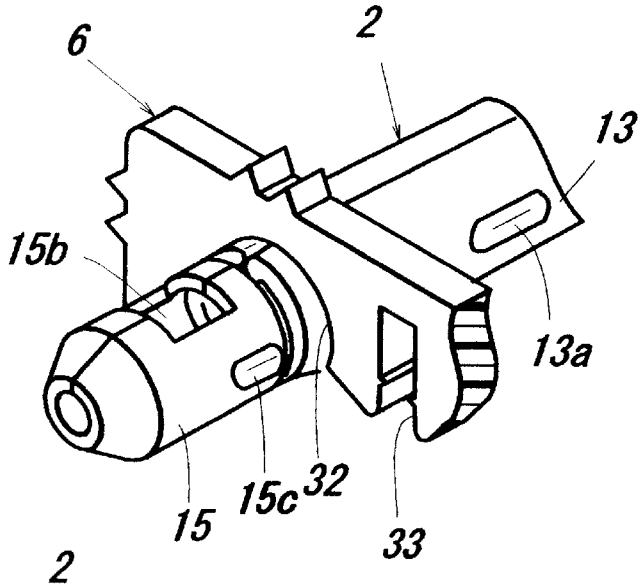
FIG. 21 is an explanatory view of function.

(10) As a final pushing step, front cover 9 is pushed against the housing 3. Thus, as FIGS. 19 and 20 show, bus bar holder 7 and bus bar 6 move to respective predetermined positions, and arm press projection 57 of front cover 9 presses locking arm 27 toward connecting terminal 2, whereupon terminal locking projection 45 of bus bar holder 7 goes into engagement with upper engagement hole 15*b* of connecting terminal 2. At the same time, as FIG. 21 shows connecting portion 14 of connecting terminal 2 is press-fitted in terminal receiving groove 32 of bus bar 6, and connecting pieces 14*a*, 14*b* having repulsiveness and elasticity are electrically connected to terminal receiving groove 32. An L-shaped arm 47 of bus bar holder 7 is locked by locking portion of housing 3 in the regular way.

(11) A plug pin 5 is inserted through rear side sealing member into a terminal insertion hole 4*a*, not in use, of housing 3.

Figure 22:
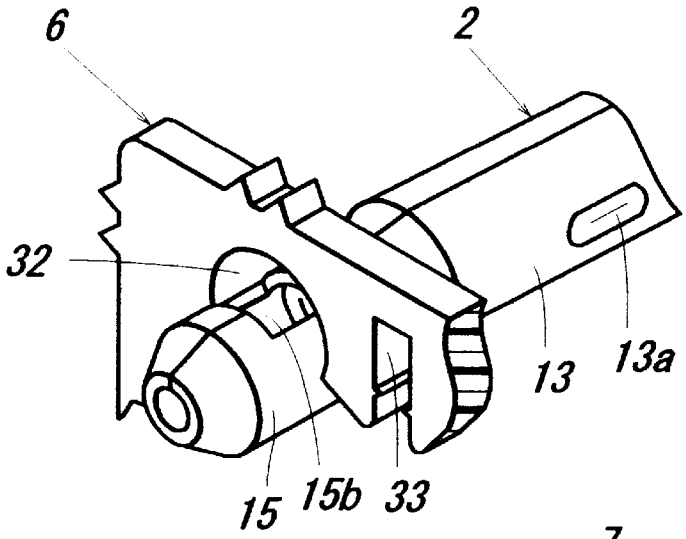
FIG. 22 is an explanatory view of function.

In the above described assembling process, in case that, as FIG. 22 shows, insertion of connecting terminal 2 is stopped before locking arm 27 is deformed, side wall of terminal receiving groove 32 of bus bar 6 impinges against beads 15*c*, 15*d* to clarify the condition of incomplete insertion of connecting terminal 2.

Figure 23:
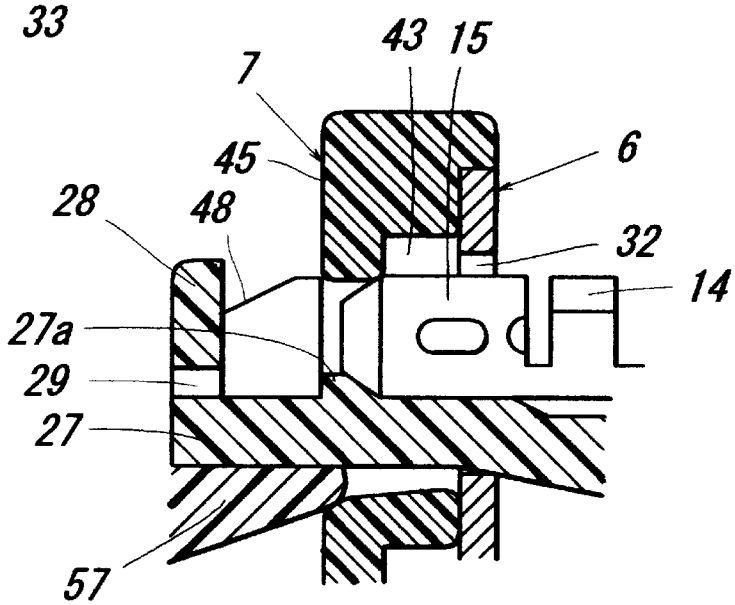
FIG. 23 is an explanatory view of function.

In case that, as FIG. 23 shows, insertion of connecting terminal 2 is stopped in such a condition that terminal locking projection 45 of bus bar holder 7 is away from upper locking hole 15*b* of connecting terminal 2, the terminal locking projection 45 abuts the portion which is away from upper engagement hole 15*b* to clarify the condition of incomplete insertion of connecting terminal 2.

Figure 24:
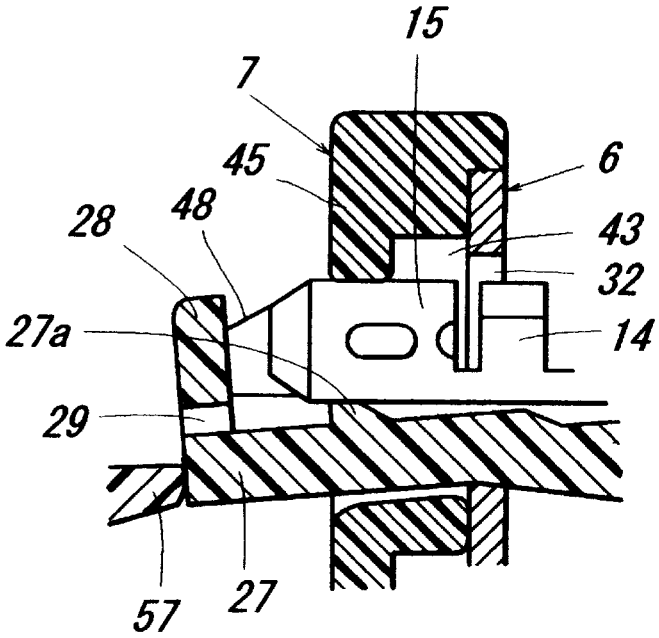
FIG. 24 is an explanatory view of function.
Figure 25:
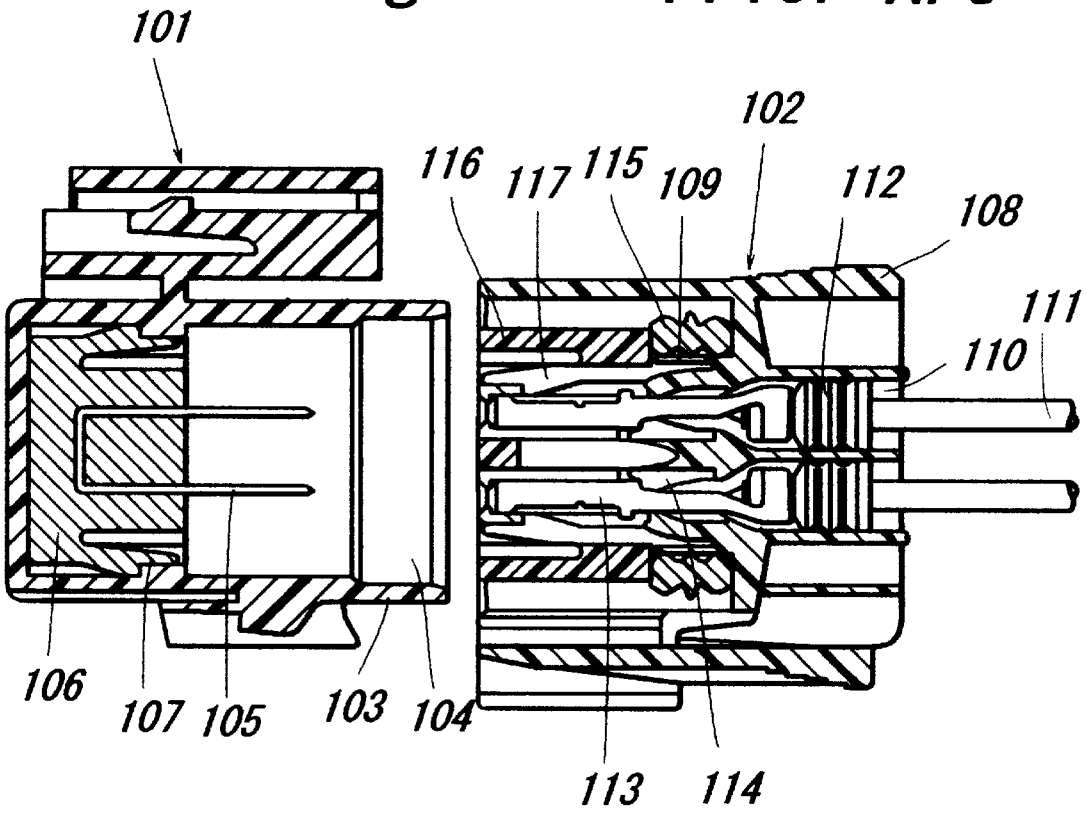
Fig. 25 Prior Art
FIG. 25 is a sectional view of a prior art example.

Further, in case that, as FIG. 24 shows, insertion of connecting terminal 2 is stopped in such a condition that locking arm 27 is deformed, arm pressing projection 57 of front cover 9 abuts the end of locking arm 27, thus making it impossible to assemble front cover 9 on housing 3, thus clarifying incomplete insertion of connecting terminal 2.

A joint connector assembled as above described has the following advantages.

(a) The circuit for bus bar can be formed by automatic punching machine. Therefore, it is no longer necessary to embed bus bar 6 in a synthetic resin material or set a cut bus bar 6 on a bus bar holder 7 as in the past. This results in manufacturing cost reduction, reduced risk of human error, which in turn results in higher reliability and improved productivity.

(b) Since bus bars 6 of same configuration can be formed with various circuits, general versatility of the bus bars is improved.

(c) Housing 3, bus bar holder 7, and front cover 9 are simplified in configuration, which results in improvement with respect to molding cycle of these members, which in turn results in fabrication cost reduction.

(d) Bus bar 6 is of planar shape, and need not be embedded in bus bar holder 7, which results in size reduction.

(e) Connecting terminal 2 is of male type and bus bar 6 is of planar shape; this makes it possible to reduce fabrication cost.

(f) For connecting bus bar 6 to connecting terminal 2, the bus bar 6 is moved in a direction orthogonal to the direction in which it is housed; this simplifies the arrangement for contact between connecting terminal 2 and bus bar 6, resulting in fabrication cost reduction.

(g) Merely by mounting front cover 9 to housing 3 it is possible to move bus bar holder 7, resulting in improvement in assembling efficiency.

(h) Since connecting terminal 2 is double locked by locking arm 27 of housing 3 and terminal locking projection 45 of bus bar holder 7, connecting terminal 2 can be assuredly locked in housing 3.

(i) Since connecting portion 14 of connecting terminal 2 is comprised of contact pieces 14*a*, 14*b* having repulsion and elasticity properties, connecting terminal 2 and bus bar 6 go into press contact so that high contact pressure can be maintained.

(j) The condition of the bus bar 6 circuit can be inspected by circuit inspection means; therefore, occurrence of defectives can be prevented.

As described above, in the joint connector according to the present invention, bus bar holder has a plurality of holes for use in cutting a bus bar and connecting individual cut bus bars arbitrarily; thus, it is possible to cause any pattern to be formed through the holes. Therefore, it is no longer necessary to embed bus bar in a bus bar holder or mount cut bus bars to a bus bar holder as has been done in the past, it being thus possible to reduce the cost of production.

What is claimed is:

1. A joint connector comprising a housing for accommodating a plurality of connecting terminals in a rear-side portion thereof, a bus bar comprised of an electrically conductive metal plate accommodated in the housing for jointing any individual ones of the connecting terminals, a bus bar holder for holding the bus bar, and a front cover mounted to the housing in such a way as to cover the bus bar holder, the bus bar holder having a plurality of holes to be used in cutting the bus bar for forming an arbitrary circuit, with the bus bar holder and the bus bar mounted so as to be movable in relation to the housing in a direction orthogonal to the direction of the connecting terminals being housed, thereby to enable the bus bar to be jointed with connecting terminals.

2. A joint connector as set forth in claim 1, wherein cutting of the bus bar is carried out by means of a cutting tool inserted into a hole of the bus bar holder.

3. A joint connector as set forth in claim 1, wherein the front cover has a pressing portion for moving the bus bar holder and the bus bar when it is mounted to the housing.

4. A joint connector as set forth in claim 1, wherein the bus bar holder has a locking portion for locking the connecting terminal at a predetermined position during aforesaid movement.

5. A joint connector as set forth in claim 1, further comprising a regulating portion for regulating aforesaid movement of the bus bar in case that the connecting terminal is not present at a predetermined position in the stage of aforesaid connection between the bus bar and the connecting terminal.

6. A joint connector as set forth in claim 1, wherein the bus bar has a terminal insert window for allowing the insertion of the connecting terminal before the movement of the bus bar, and a terminal receiving groove for receiving the connecting terminal after the movement of the bus bar.

7. A joint connector as set forth in claim 1, wherein a clearance between the housing and the front cover is waterproofed by a sealing member.

8. A joint connector as set forth in claim 1, wherein the housing has a locking arm for locking the connecting terminals housed at a predetermined position, and wherein the front cover has a pressing portion for pressing the locking arm toward the connecting terminal.

9. A joint connector as set forth in claim 8, wherein the locking arm has a regulating portion for regulating the forward movement of the connecting terminal.

* * * * *